United States Patent [19]

Asano et al.

[11] 4,204,397

[45] May 27, 1980

[54] ELECTRONIC TIMEPIECE

[75] Inventors: Kazuhiro Asano; Makoto Ueda; Akira Torisawa; Masaharu Shida; Katsuhiko Satoh; Masaaki Mandai, all of Tokyo, Japan

[73] Assignee: Kabushiki Kaisha Daini Seikosha, Japan

[21] Appl. No.: 898,399

[22] Filed: Apr. 20, 1978

[30] Foreign Application Priority Data

Apr. 23, 1977 [JP] Japan ..... 52-47089

[51] Int. Cl.[2] ..... G04C 3/00

[52] U.S. Cl. ..... 368/202; 368/155

[58] Field of Search ..... 58/23 A, 23 D, 23 BA, 58/23 R, 152 H; 340/373, 636, 663, 672; 318/696, 685

[56] References Cited

U.S. PATENT DOCUMENTS 4,150,536 4/1979 Nakajima ..... 58/23

*Primary Examiner*—J. V. Truhe

*Assistant Examiner*—Leonard W. Pojunas, Jr.

*Attorney, Agent, or Firm*—Robert E. Burns; Emmanuel J. Lobato; Bruce L. Adams

[57] ABSTRACT

An electronic timepiece reduces power consumption by normally driving the stepping motor with a short pulse and driving the motor with a wide pulse under heavy load conditions by sensing the rotor position. A detection circuit senses the voltage drop across a detection element in series with the motor coil for driving a first detection pulse and senses again for driving a second detection pulse. If the second voltage drop is larger, then the rotor is not rotating whereupon the wide pulse is used to drive the motor.

4 Claims, 18 Drawing Figures

FIG. 7
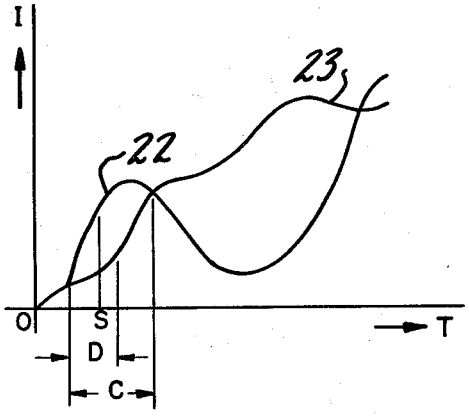
FIG. 8
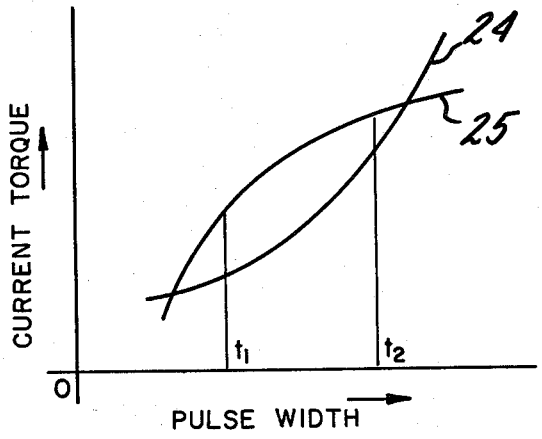
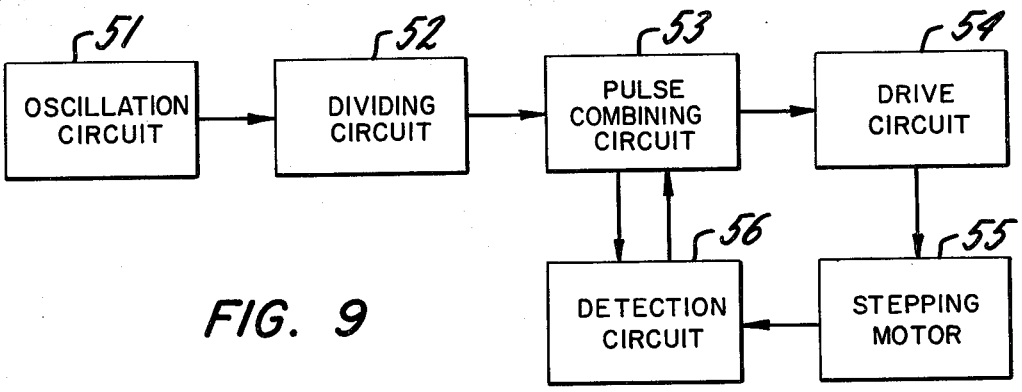
FIG. 9

ELECTRONIC TIMEPIECE

BACKGROUND OF THE INVENTION

The present invention relates to an electronic timepiece, and to a reduction of power consumption in the electronic timepiece by switching a drive pulse width which is applied to a stepping motor in accordance with the load whereby attains a suitable drive and a low power consumption of a stepping motor is attained.

The display mechanism of an analogue type crystal watch heretofore used is generally constructed as shown in FIG. 1. The output of a motor comprising a stator 1, a coil 7 and a rotor 6 is transmitted to a fifth wheel 5, a fourth wheel 4, a third wheel 3 and a second wheel 2. Although not shown the output is then transmitted to a cylindrical member, a cylindrical wheel and a calendar mechanism, whereby a second hand, a minute hand, and hour hand and a calendar are driven.

In the case of wrist watch, a load from the stepping motor is extremely small except for the time for switching the calendar, so that the torque of 10 g/cm in the second wheel is enough for the driving. However, when switching the calendar, the torque of several times higher than this is required. The time required for switching the calendar within twenty-four hours operation is only at most about six hours. However, for the reasons described above in the mechanism according to the prior art, there is a problem that electric power which enables the calendar driving mechanism to be operated in a stable condition must be always supplied from a power supply.

FIG. 2 shows an electronic watch circuit construction according to the prior art. The signal of 32768 KHZ from an oscillation circuit 10 is converted to a one second signal by a frequency dividing circuit. The one second signal is converted to a signal having a 7.8 ms width and a period of 2 seconds by a pulse width combining circuit, and a signal having the same period and pulse width which is dephased by one second are applied to the inputs 15 and 16 of the inverters 13*a* and 13*b*.

As a result, an inverted pulse which changes the direction of the current is applied to a coil 14 every one second, so that the rotor 6 magnetized in two poles rotates in one direction. FIG. 3 shows the current waveform thereof. In this manner, the drive pulse width of the present day electronic watch is set by the required maximum torque as its standard. Therefore, in the time interval which does not require a large torque, electric power is wasted. This has prevented the lower power consumption of the watch.

SUMMARY OF THE INVENTION

In order to overcome these difficulties, in the electronic watch according to the present invention, a motor is driven by a pulse having a shorter pulse width than the conventional ones and afterwards a detected pulse is applied to the motor coil so as to determine rotation of the rotor, and the rotation of the rotor is detected by a voltage level across a resistor connected in series to the coil and if the rotor fails to rotate a correction is effected by driving the motor by the pulse having a wider pulse width.

BRIEF DESCRIPTION OF THE DRAWINGS

FIG. 7 is a waveform of coil current of FIGS. 4–6, FIG. 8 is a characteristic curve relating to the drive pulse width of a motor for current and torque, FIG. 9 is a block diagram of an electronic timepiece of the present invention, FIG. 10(*a*) is a time chart of the circuit block diagram of FIG. 10(*b*), FIG. 10(*b*) is a circuit block diagram of a pulse combining circuit of the invention, FIG. 11(*a*) is a circuit diagram of one embodiment of a pulse combining circuit, detection circuit and drive circuit of the invention, FIG. 11(*b*) is a time chart of the circuits of FIG. 11(*a*)

DETAILED DESCRIPTION OF THE INVENTION

Figure 1:
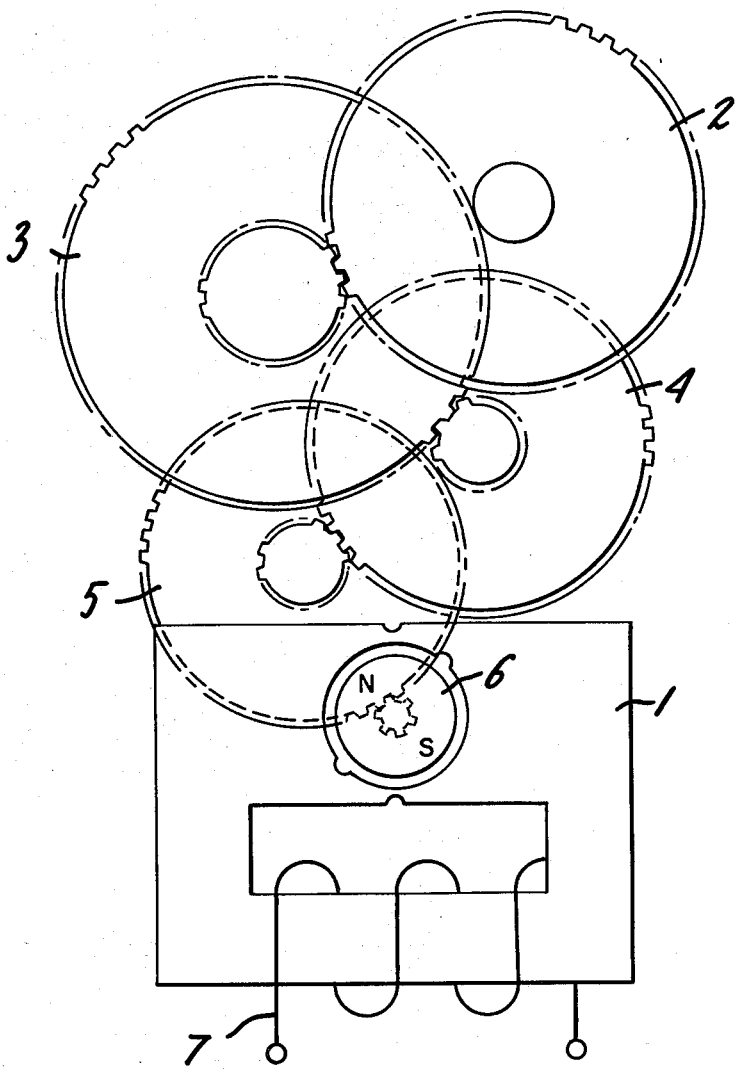
FIG. 1 PRIOR ART
FIG. 1 is a top view of a conventional analogue type electronic timepiece mechanism.

FIG. 9 shows a circuit block diagram of an entire electronic timepiece of the present invention, numeral 51 is an oscillation circuit which generates a time standard signal. A dividing circuit 52 is composed of multi-stages of flip-flops and divides until a one second signal is obtained. A pulse combining circuit 53 combines the divided signals to obtain a detection pulse for detection, a correction drive and a normal drive pulse signal having a time width for normal driving from the outputs of said flip-flops of said. Further, a signal is generated which is preferable to operate the drive circuit 54 and the detection circuit 56.

Said drive circuit 54 receives a normal drive pulse signal from said pulse combining circuit 53, and thereby drives a stepping motor 55. Said detection circuit 56 receives a detection pulse from said pulse combining circuit 53 and detects a rotation condition and non-rotation of the stepping motor 55, whereby a signal representative of the detected condition is applied to the pulse combining circuit 53. A rotor of the stepping motor 55 is rotated in the case of a low load by applying said normal drive pulse, and is not rotated in the case of a high load. Therefore one is able to detect a rotation and non-rotation of rotor by applying detection signal to the detection circuit 54 which senses a difference of inductance in the rotation and non-rotation of the rotor.

Figure 3:
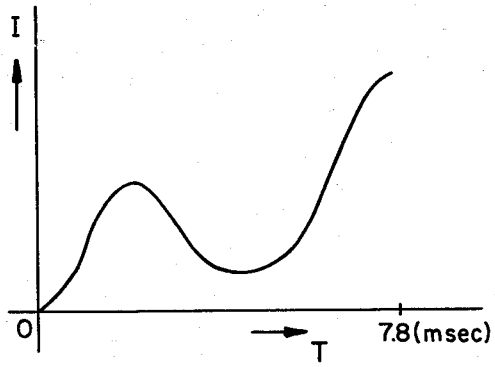
PRIOR ART FIG. 3
FIG. 3 shows a waveform of the coil current of FIG. 1, FIGS. 4 to 6 are diagrammatic views of the operational principles of a stepping motor of the present invention.
Figure 4:
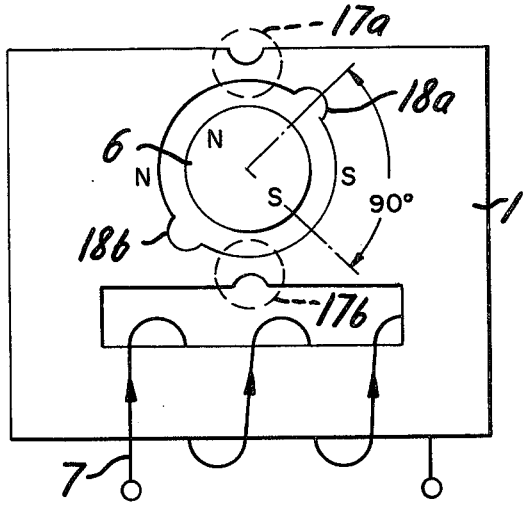

Said pulse combining circuit 53 receives a signal from said detection circuit 56, and it is necessary to apply a correction drive pulse to the drive circuit 54 in case of non-rotation of the rotor. Said correction drive pulse has a longer pulse width than the normal pulse, therefore the torque is very high, and it is able to drive the stepping motor in a high load condition. The principle of the rotation of a stepping motor for use in the electronic watch and rotation and non-rotation detection are as follows:

Referring to FIG. 4, numeral 1 shows a stator constructed in one formed body having a magnetic path or circuit 17*a*, 17*b* which is easily saturable. The stator is magnetically engaged with a magnetic core with the coil 7. In order to determine the direction of the rotation of the rotor 6 with two magnetic poles provided in the direction of the diameter, a notch 18*a*, 18*b* is provided with the stator. In FIG. 4, the condition is shown in which electric current has just been applied to the coil 7, the rotor 6 remains stationary at the position of approximately 90 degrees in angle between the notch 18*a*, 18*b* and the magnetic poles of the rotor. In this condition, when, in the coil 7, the current is flowing in the direction of the arrow mark, the magnetic poles are produced in the stator 1 as shown in FIG. 4, so that the rotor 6 rotates in the clock-wise direction by the poles repulsing each other. When the current flowing through the coil 7 is interrupted, the rotor 6 will be positioned in the reversed condition in the magnetic poles against the previous condition in FIG. 4. Afterwards, the rotor 6 keeps sequentially rotating in the clock-wise by flowing the current in the opposite direction. Since the stepping motor used in the electronic watch according to the present invention is constructed in one integral body having saturable portion 17*a*, 17*b* the current waveform flowing through the coil 7 presents a characteristic with the slow rising curve as shown in FIG. 3. The reason for this is that when the saturable portions 17*a*, 17*b* of the stator 1 are not saturated, the magnetic resistance of the magnetic circuit seen from coil 7 is very small so that the time constant $\tau$ of the series circuit of the resistor and the coil becomes very large. The equation of this condition can be expressed as follows:

$$\tau = L/R,\ L \simeq N^2/Rm$$

Therefore, the following equation is established:

$$\tau = N^2/(R \times Rm)$$

where L denotes the inductance of the coil 7: N is number of turns of the coil 7: Rm is magnetic resistance.

When the saturable portions 17*a*, 17*b* of the stator 1 are saturated, the permeability therefore becomes the same as that of the air. Accordingly, the Rm increases and the time constant $\tau$ of the circuit becomes smaller and the waveform of the current rises abruptly as shown in FIG. 3.

According to the present invention, the detection of of the rotation or non-rotation of the rotor 6 for use in the electronic wrist watch is detected as the difference of the time constant of the circuit consisting of the resistor and coil connected in series. The reason for producing the difference of the time constants will now be explained hereinafter.

Figure 5:
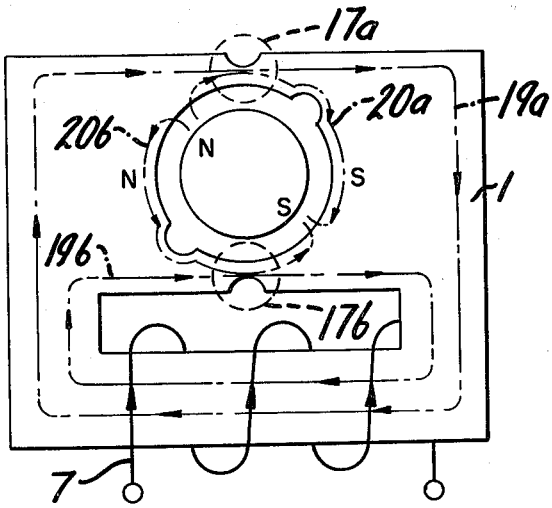

FIG. 5 shows a magnetic field at the time of the current flowing through the coil 7. In the figure, the rotor 6 is in the position which is rotatable against the magnetic poles. The magnetic flux 20 is the one which is derived from the rotor 6. The magnetic flux which intersects the coil 7 also exists practically, however, this is neglected here. The magnetic fluxes 20*a* and 20*b* are shown as being derived from the saturable portions 17*a*, 17*b* of the stator 1 and they are directed in the arrow mark. The saturable portion 17*a*, 17*b* are in most cases, not in the saturated condition yet. In this condition, the current is flowing in the direction of the arrow mark of the coil 7 so as to rotate the rotor 6 clockwise. The magnetic fluxes 19*a* and 19*b* produced by the coil 7 are added to the magnetic fluxes 20*a* and 20*b* produced by the rotor 6 within the saturable portions 17*a*, 17*b*, so that the portions 17*a*, 17*b* of the stator 1 rapidly saturates. Afterwards, the magnetic flux which is sufficient for rotating the rotor 6 is produced. However, this is omitted in FIG. 5. FIG. 7 shows the waveform of the current flowing through the coil, as numeral 22.

Figure 6:
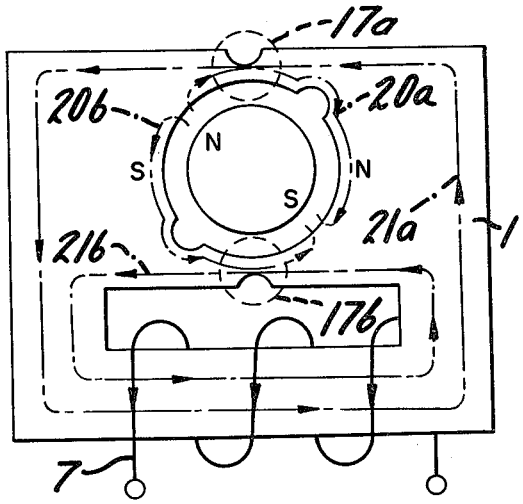

FIG. 6 shows the condition of the magnetic flux in which the current is flowing through the coil 7 at the time when the rotor 6 can not be rotated for some reasons and is returned to the original point. Generally, in order to rotate the rotor 6, the current must be flowing in the coil 7 in the opposite direction against arrow mark, i.e., in the same direction as that as shown in FIG. 5. However, in this case since an alternating inverted current is applied to the coil 7 for every rotation, this condition occurs whenever the rotor 6 can not be rotated. Since the rotor 6 can not be rotated in this case, the direction of the magnetic flux produces the one shown in FIG. 5. In this case, since the current is flowing in the opposite direction against FIG. 5, the direction of the magnetic fluxes is 21*a* and 21*b*. In the saturable portions 17*a*, 17*b*, the magnetic fluxes produced respectively from rotor 6 and the coil 7 cancel each other, so that in order to saturate the portion of the stator 1, a longer time is required. FIG. 7 shows this condition as numeral 23. In this embodiment, the time interval "D" before the portions 17*a*, 17*b* of the stator 1 saturate in FIG. 7, was 1 msec, under the condition that the diameter of the coil is 0.23 mm, the number of turns is 10,000, the coil series resistance is 3 K Ω, the diameter of the rotor is 1.3 mm and the minimum width of the saturable portion is 0.1 mm. As it is apparent from the waveforms 22 and 23 of the two currents in FIG. 7, the inductance of the coil is small when the rotor 6 is rotating within the range of "C" in FIG. 7 while it is large at the time of non-rotation. In the stepping motor as described above, the equivalent inductance in the range of "D" was chosen as L=5 henry at the current waveform of 22 when rotating, and was chosen as L=40 henry at the waveform 23 during non-rotation.

Figure 10A:
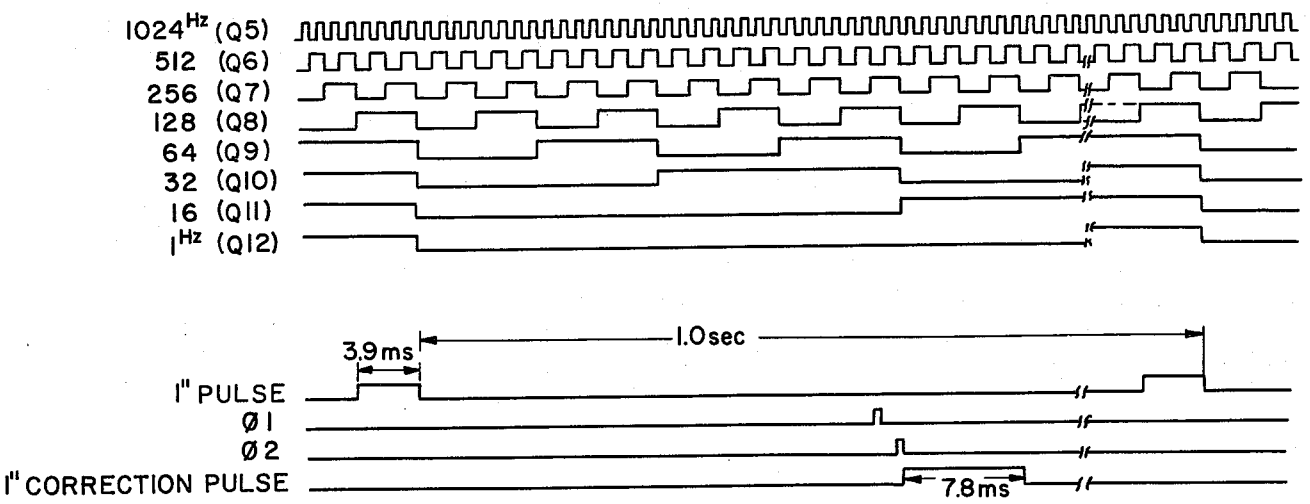
Figure 10B:
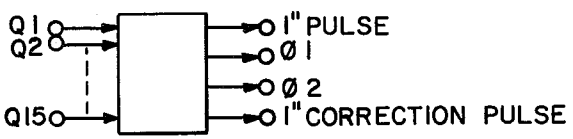

Referring now to a pulse combining circuit 53, a driving circuit 54 and a detection circuit 56 as the important points of the present invention:

FIG. 10(*a*) shows a time chart and FIG. 10(*b*) its block diagram of said pulse combining circuit 53, and shows the timings of 1 sec pulse, 1 sec correction pulse and detection pulses $\phi 1$ and $\phi 2$.

These above noted signals are easily obtained through combination by arranging the gates of outputs "Qn" of said dividing circuit 52. Each equation is as follows:

1 sec. pulse=Q8, Q9, Q10, Q11, Q12, Q13, Q14 and Q15.

1 sec. correction pulse=$\overline{Q9}$, $\overline{Q10}$, Q11, $\overline{Q12}$, $\overline{Q13}$, $\overline{Q14}$ and $\overline{Q15}$.

$\phi 1$=$\overline{Q5}$, $\overline{Q6}$, Q7, Q8, Q9, Q10, $\overline{Q11}$, $\overline{Q12}$, $\overline{Q13}$, $\overline{Q14}$, $\overline{Q15}$.

$\phi 2$=Q5, Q6, Q7, Q8, Q9, Q10, $\overline{Q11}$, $\overline{Q12}$, $\overline{Q13}$, $\overline{Q14}$, $\overline{Q15}$.

Q5: 1024 HZ, Q4: 512 HZ Q15: 1 HZ.

Therefore, the pulse width of said signals are as follows:

1 sec pulse: 3.9 msec.

1 sec correction pulse: 7.8 msec.

$\phi$: 0.5 msec.

Figure 11A:
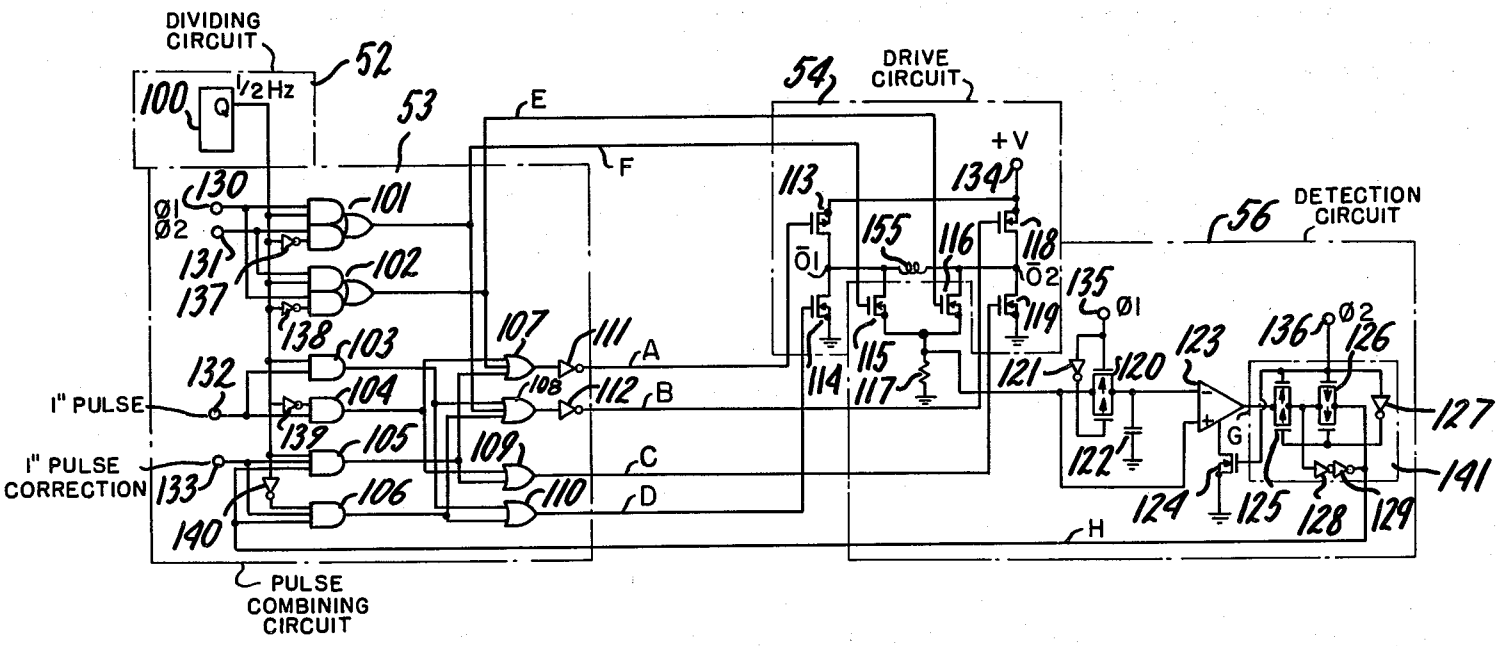
Figure 11B:
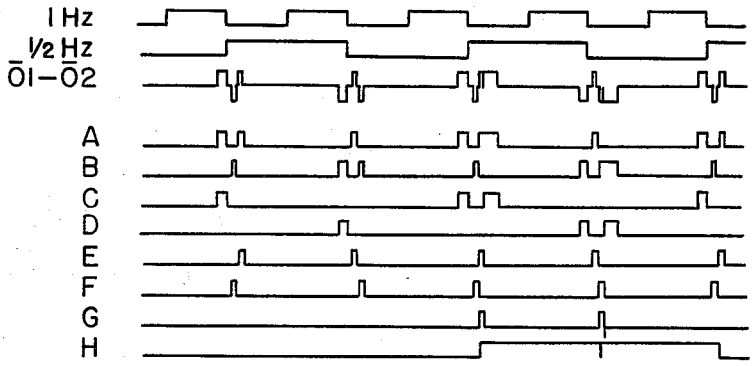

These signals are applied to a circuit of FIG. 11 and changed to a preferable signal for driving said drive circuit 54.

FIG. 11(*a*) shows one embodiment of said pulse combining circuit 53, driving circuit 54 and detection circuit.

Numeral 100 is a flip-flop, the output of said flip-flop 100 is connected to one control input of AND-OR-gates 101 and 102, another control input via the inverters 137 and 138, a first input of AND-gates 103 and 105 and first inputs of AND-gates 104 and 106 via the inverters 139 and 140.

A first input of AND-OR-gate 101 is connected to a terminal 130, and $\phi$1 as one part of output of a pulse combining circuit in FIG. 10 is applied to said terminal 130. A second input thereof is connected to a terminal 131, and $\phi$2 is applied to said terminal 131.

The first input of AND-OR-gate 102 in connected to said terminal 131, a second input is connected to said terminal 130, and thus $\phi$1 and $\phi$2 are respectively connected thereinto.

The outputs of AND-OR-gates 101 and 102 are the detection pulses, and are connected to the gate terminals of NMOSFETS 115 and 116, and are connected to the second input terminals of OR-gates 107 and 108.

The other inputs of AND-gates 103 and 104 are connected to a terminal 132, and a pulse which is an output of the 1" pulse combining circuit as shown in FIG. 10 is applied thereinto. The second inputs of AND-gates 105 and 106 are connected to a terminal 133, with a 1" correction pulse applied thereinto, and an output of a latch circuit 141 is connected to a third input.

An output of AND-gate 103 is one signal of an inverted 1" pulse and is connected to one input of OR-gates 108 and 109, an output of AND-gate 104 is other signal of said inverted 1" pulse and is connected to one input of OR-gates 107 and 109.

An output of AND-gate 105 is one signal of an inverted 1" correction pulse and is connected to other input of OR-gate 109 and a third input of OR-gate 107.

An output of AND-gate 106 is another signal of said inverted 1" correction pulse and is connected to another input of OR-gate 110 and a third input of OR-gate 108. An output of OR-gate 107 is connected to a gate of PMOSFET 118 through an inverter 112. An output of OR-gate 109 is connected to a gate of NMOSFET 119, an output of OR-gate 110 is connected to a gate of NMOSFET 114.

The above noted circuit construction is the pulse combining circuit 53. The construction of a driving circuit 54 and detection circuit 56 are now referred to.

Numeral 134 is a positive terminal of a power source, and the source electrodes of PMOSFETS 113 and 118 are connected thereto. The source electrodes of NMOSFETS 114 and 119 are grounded, the drain electrodes of PMOSFET 113 and NMOSFET 114 are connected each other and are connected to one terminal of a coil 155 of the stepping motor 55 and a drain electrode of detection NMOSFET 115.

The drain electrodes of PMOSFET 118 and 119 are connected to each other and are connected to another terminal of the coil 155 of said stepping motor 55 and a drain electrode of detection NMOSFET 116.

The source electrodes of NMOSFETS 115 and 116 are connected to each other, a connection point between said source electrodes thereof is connected to one terminal of a resistor 117, and the other terminal of said resistor 117 is grounded.

The connection point of said resistor 117 and NMOSFETS 115 and 116 is connected to a positive input of a comparator 123 and transmission-gate 120 (referred to as "TG" hereinafter). An output of TG 120 is connected to an electrode of the other terminal of a condensor 122 in which one terminal is grounded and the negative terminal of said comparator 123. A terminal 135 is connected to a control terminal of TG 120, with $\phi$1 as one part of the output of said pulse combining circuit of FIG. 10 applied thereto.

The output of said comparator 123 is connected to a data-terminal of a latch circuit 141 which is composed of TG 125 and 126 and inverters 127 to 129, and NMOSFET 124 of which the gate is connected to said terminal 136 is connected to a power source terminal of comparator 123 which is grounded through the source said NMOSFET 124.

An output of said latch circuit 141 is fed back to the pulse combining circuit 53 and is connected to the third inputs of AND-gates 105 and 106.

In the above noted circuit construction, referring now to the operation:

When an output of F/F 100 is in the "H" condition, $\phi$1 is generated from AND-OR-gate 101, and $\phi$2 is generated from AND-OR-gate 102. NMOSFET 115 turns "ON" by said $\phi$1, and PMOSFET 118 turns "ON" through OR-gate 108 and inverter 112.

At this time, a current is flowing through PMOSFET 118, coil 155, NMOSFET 115 and resistor 117, whereby a voltage drop occurs across the terminals of said resistor 117.

Figure 12:
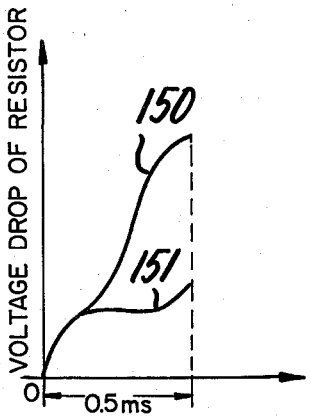
FIG. 12 is a characteristic curve of a voltage drop-time of the detection resistor of the invention, FIGS. 13(*a*) and (*b*) are circuit diagrams of two embodiments of a comparator, FIGS. 14(*a*) and (*b*) are the characteristic curves of the circuits of FIGS. 13(*a*) and (*b*).

Further, when $\phi$1 is in the "H" condition, TG 120 turns "ON", whereby a voltage which is equal to a voltage drop of said resistor 117 is memorized in the condenser 122. Said voltage becomes the same waveform as the current waveform as shown in FIG. 7 since the current is changed with a voltage drop of a resistor, therefore it is able to detect a difference of rotation and non-rotation as shown in FIG. 12 by setting a detection pulse width. $\phi$1 is a pulse which has the same direction of a drive pulse for rotating a rotor, if a rotor is rotated by a next pulse, i.e., if a rotor is rotated by a former pulse, said voltage rises earlier as shown in "150" of FIG. 12, and the voltage which is memorized in a condenser 122 is high.

Figure 2:
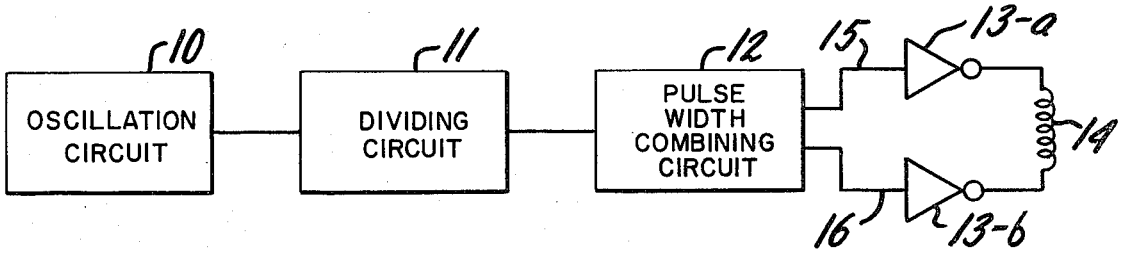
FIG. 2 PRIOR ART
FIG. 2 is a circuit block diagram of a conventional electronic timepiece.

On the contrary, if a rotor is not rotated by a former pulse, a voltage becomes lower as shown in "151" of FIG. 2.

If $\phi$2 is generated from AND-OR-gate 102, PMOSFET 113 and NMOSFET 116 turn "ON", whereby a voltage drop occurs at said resistor 117. At this time, said TG 120 turns "OFF", a voltage drop according to said $\phi$1 is memorized in the condenser 122 and is applied to the negative input terminal of the comparator 123. A voltage drop which was generated by $\phi$2 in the resistor 117 is applied to the positive terminal of the comparator 123.

At this time, NMOSFET 124 turns "ON" by $\phi$2, whereby the comparator 123 is operated, a latch circuit 141 is in a reading condition. A current direction which is flowing to the coil 155 by $\phi$2 is an inverted one against $\phi$1. Therefore, if the rotor was rotated by a former drive pulse, the rise time of the current according to $\phi$2 becomes longer, whereby the voltage drop becomes lower as shown in "151 of FIG. 12.

On the contrary, if the rotor was not rotated by a former drive pulse, the current direction of the coil 155 according to $\phi 2$ is the direction for being able to rotate the rotor, the rise time of the current is fast, the voltage drop as shown in "150" of FIG. 12 becomes larger.

The comparator 123 generates the output "L" when a voltage drop "V$\phi$2" according to $\phi 2$ and a voltage drop "V$\phi$1" according to $\phi 1$ are maintained in the relation of V$\phi$1>V$\phi$2, further generates the output "H" in V$\phi$2>V$\phi$1. Said output is memorized in the latch circuit 141.

When the output of said latch circuit 141 becomes "H", the third inputs of AND-gates 105 and 106 become "H", a correction pulse "1" is generated from AND-gate 105 since an output of F/F100 is "H".

Said pulse signal changes PMOSFET 113 and NMOSFET 119 to "ON", a drive pulse which is same direction in the former is applied to the rotor for a long time as a correction drive pulse, whereby said rotor is rotated. Further a normal 1" pulse is generated through AND-gate 103, whereby PMOSFET 118 and NMOSFET 114 are turned "ON", and the rotor is rotated.

The output of F/F 100 is inverted by the down portion of the 1" pulse, whereby "$\phi$1" is generated from AND-OR-circuit 102, "$\phi$2" is generated from AND-OR-circuit 101, and the same detection as above noted is carried out. These conditions are indicated in a time-chart of FIG. 11(*b*).

Figure 13A:
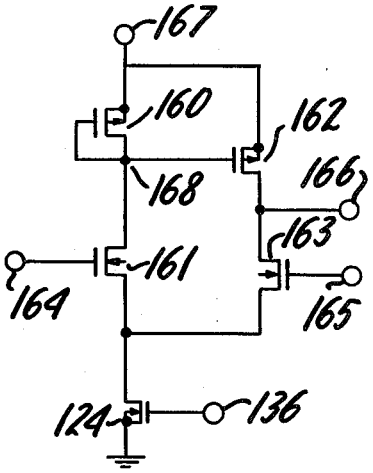
Figure 13B:
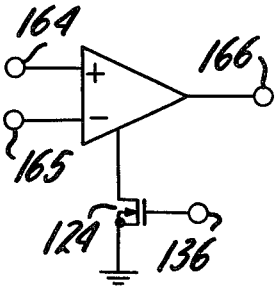

Referring now to the operation and construction of the comparator 123 of CMOS-construction:

FIGS. 13(*a*) and (*b*) show one embodiment of the comparator 123, with FIG. 13(*a*) showing a detailed circuit construction, and FIG. 13(*b*) showing a block diagram.

A terminal 164 is a positive input terminal, a terminal 165 is a negative input terminal, a terminal 166 is an output terminal, a terminal 136 is an "ENABLE" terminal. These functions are shown as TABLE-1:

TABLE 1

| Positive Input Terminal | | Negative Input Terminal | Enable Terminal | Output Terminal |
|---|---|---|---|---|
| — | | — | 0 | — |
| V+ | > | V− | 1 | "H" |
| V+ | < | V− | 1 | "L" |

Numeral 167 is a power source terminal which is connected to the source electrodes of PMOSFETS 160 and 162. The gate and drain electrodes of PMOSFET 160 are connected, a connected point thereof is connected to a gate of PMOSFET 162 and the drain of NMOSFET 161.

The gate of NMOSFET 161 is connected to a terminal 169, the source electrode thereof is connected to the drain electrode of NMOSFET 124. The drain electrode of PMOSFET 162 is connected to the drain electrode of PMOSFET 163 and output terminal 166. The gate electrode of NMOSFET 163 is connected to a terminal 165, the source electrode thereof is connected to the drain electrode of NMOSFET 124 together with the source electrode of NMOSFET 161.

The source electrode of NMOSFET 124 is grounded, and the gate electrode thereof is connected to a terminal 136. Further, the characteristics of NMOSFETS 161 and 163 and PMOSFETS 160 and 162 are equal respectively.

Referring now to the operation of the comparator of the above noted construction: when the "ENABLE"-terminal is in the "L" position, NMOSFET 124 turns "OFF", whereby the comparator is not operated. When the terminal 136 is in the "H"-position, NMOSFET 124 turns "ON", whereby the comparator is operated.

Figure 14A:
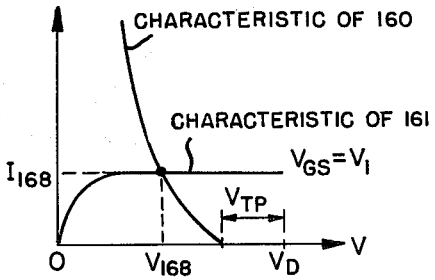
Figure 14B:
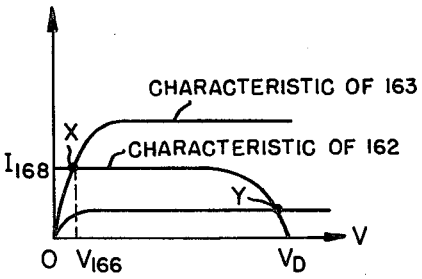

When an input voltage "V1" is applied to the terminal 164, a voltage and current of the connected point 168 are in the condition as shown in FIG. 14(*a*).

In FIG. 14(*a*), "V168" is a voltage of the terminal 168, "I168" is a current of flowing in the terminal 168. A saturation current of PMOSFET 162 becomes equal to said "I168" since said "168" is applied to a gate electrode of PMOSFET 162, said condition is shown in the characteristic of "162" of FIG. 14(*b*).

Further, if a voltage which be applied to the terminal 165 is "V2", a saturation current becomes larger than said "I168" in the case of V2>V1. Therefore, a voltage "V166" of the output terminal 166 in the neighbourhood of "L"-level. Said condition is shown in the operation point "x" of FIG. 14(*b*).

On the contrary, the output "V166" becomes the "H" level the case of V2<V1, said condition is shown in "Y" of FIG. 14(*b*). Therefore, the function thereof is shown in TABLE-1.

According to the present invention, the rotor is rotated by a short drive pulse in a small load condition, further the rotor is rotated by a long drive pulse in a high load condition only when said rotor is not rotated by said short drive pulse, thereby power consumption is reduced.

One is able to obtain an accurate electronic watch without a correction step since the electronic watch of the present invention be able to eliminate the affections of an accuracy of a detection resistor, changes of threshold voltage and temperature irregularities by comparing a voltage drop of a detection resistor for rotation or non-rotation of the rotor.

Therefore, it is very easy to make an electronic watch by integrated circuit technology, and to reduce cost, whereby an electronic watch of low power consumption is easily obtained.

According to the embodiment of the present invention, detection pulses $\phi 1$ and $\phi 2$ of two phases are continuously generated, and the comparison of levels is attained. Other modifications of the number of pulses and their arrangements are included to the present invention.

In spite of the kind of motor, an electronic timepiece which has a motor having a difference of inductance of the coil of the motor in the case of rotation or non-rotation of the rotor is included in the present invention.

We claim:

1. An electronic timepiece comprising: a stepping motor having a coil and a rotor; means for generating a normal drive pulse sufficient to drive the motor under normal loading but insufficient to drive the same under worst case loading, a drive correction pulse sufficient to drive the motor under worst case loading and two out-of-phase detection pulses; a drive circuit receptive of the normal drive pulse and the drive correction pulse for driving the stepping motor; and a detection circuit for detecting the rotary position of the motor rotor comprising a detection element, and a voltage comparison circuit for comparing the voltage drop across said detection element during the first detection pulse when current flows in one direction of the motor coil with the voltage drop across said detection element during the second detection pulse when current flows in the opposite direction of the motor coil whereby if the rotor is rotating, the current will flow in the opposite direction in the coil and the voltage drop is lower than that during the first detection pulse and if the rotor is not rotating, the voltage drop is greater.

2. An electronic timepiece as claimed in claim 1, further comprising means responsive to an unfavorable comparison indicating that the rotary position of said rotor is not preferable to effect movement of said rotor to a perferable position by operation of said drive circuit.

3. An electronic timepiece according to claim 1; wherein said comparison circuit comprises a comparator having two inputs receptive of the two voltage drops and an output enable control input receptive of the second detection pulse for effecting the enablement thereof.

4. An electronic timepiece according to claim 3; wherein said comparison circuit further comprises a sample and hold circuit enabled by the first detection pulse and having an input connected between said coil and detection element for storing the voltage drop associated with the first detection pulse and having an output connected to one input of said comparator and wherein the second input of said comparator is connected to the input of said sample and hold circuit.

* * * * *